US005713565A

United States Patent [19]

Meier

[11] Patent Number: 5,713,565

[45] Date of Patent: Feb. 3, 1998

[54] PROCESS FOR PROCESSING PRINTED PRODUCTS

[75] Inventor: Jacques Meier, Baretswil, Switzerland

[73] Assignee: Ferag Ag, Hilwil, Switzerland

[21] Appl. No.: 433,156

[22] Filed: May 3, 1995

[30] Foreign Application Priority Data

May 4, 1994 [CH] Switzerland ..... 01 399/94

[51] Int. Cl.[6] ..... B65H 39/00

[52] U.S. Cl. ..... 270/52.16; 270/52.29; 270/52.3

[58] Field of Search ..... 270/54, 55, 57, 270/58, 52.14, 52.16, 52.26, 52.29, 52.3; 271/204, 9.04, 151, 216, 9.13

[56] References Cited

U.S. PATENT DOCUMENTS

| | | | |
|---|---|---|---|
| 3,758,103 | 9/1973 | Gianese | 271/9.04 X |
| 3,951,399 | 4/1976 | Reist . | |
| 4,058,202 | 11/1977 | Reist et al. . | |
| 4,381,596 | 5/1983 | Simonton et al. | 271/9.04 X |
| 4,466,603 | 8/1984 | Schnell . | |
| 4,489,930 | 12/1984 | Meier | 270/55 |
| 4,604,851 | 8/1986 | Reist | 271/204 X |
| 4,606,173 | 8/1986 | Meier | 271/204 X |
| 4,706,951 | 11/1987 | Leu | 270/55 |
| 5,019,716 | 5/1991 | Meier et al. . | |
| 5,052,666 | 10/1991 | Hansch | 270/55 |
| 5,052,667 | 10/1991 | Hansch | 270/55 |
| 5,094,438 | 3/1992 | Reist et al. | 270/55 |
| 5,104,108 | 4/1992 | Honegger | 270/55 |
| 5,324,014 | 6/1994 | Honegger et al. | 270/55 |

FOREIGN PATENT DOCUMENTS

| | | | |
|---|---|---|---|
| 0218872 | 4/1987 | European Pat. Off. . | |
| 0344102 | 11/1989 | European Pat. Off. . | |
| 0280694 | 10/1990 | European Pat. Off. . | |
| 0550828 | 7/1993 | European Pat. Off. . | |
| 3018987 | 11/1981 | Germany . | |
| 63-252874 | 10/1988 | Japan | 270/58 |
| 1-306289 | 12/1989 | Japan | 270/55 |

*Primary Examiner*—Hoang Nguyen
*Attorney, Agent, or Firm*—Brinks Hofer Gilson & Lione

[57] ABSTRACT

A method of producing printed products comprising a plurality of individual component products such as newspapers or periodicals or the like. In the method the products are brought together at processing stations, following one after the other along a processing section, by depositing said products on successive rests and are then raised up from the rests and conveyed away. Prescribed rests are excluded from the charging at certain processing stations in order to permit the simultaneous production of products of different types.

50 Claims, 5 Drawing Sheets

PROCESS FOR PROCESSING PRINTED PRODUCTS

FIELD OF THE INVENTION

The invention relates generally to a method of producing printed products. It relates particularly to an improved method of producing printed products such as newspapers and periodicals and the like from a variety of component products.

BACKGROUND OF THE INVENTION

In known methods of producing printed products, component products are either collected on circulating saddle-like rests or collated or inserted in receiving pockets formed between two adjacent saddle-like rests. The saddle-like rests are mounted in either a drum system, on a rotating cylindrical drum, or in a circulating system, on an endless member which is driven in circulation around two spindles spaced horizontally from each other.

Provided above the rotating or circulating saddle-like rests are component product feed stations. Component products are fed from these feed stations onto the saddle-like rests or into the pockets formed therebetween in order to bring them together into the assembled printed products which are being produced. The assembled printed products, brought together in this manner, are then individually seized, by separate grippers, for example, and conveyed away from the saddle-like rests, or the pockets formed therebetween, for the purpose of further processing.

The known methods for operating a drum system or circulating system can be used to produce different types of printed products. In order to produce a specific type, however, only specific component product feed stations are activated and/or different individual component products are fed to the processing stations. The disadvantage with known methods is that such specifically configured drum systems or circulating systems permit only a single type of printed product, which corresponds to the specific system configuration, to be produced in each case. Conversion work on the system is necessary before a different type of printed product can be produced.

SUMMARY OF THE INVENTION

An object of the present invention is to provide a method of producing a plurality of different types of printed products simultaneously.

The method of the invention permits products of different types to be produced simultaneously in a simple manner using a single drum system or single circulating system. No mechanical changes are necessary for carrying out the method of the invention on known drum systems or circulating systems. This is, of course, advantageous from economic points of view.

A simple example of the invention method is the production of a daily or weekly newspaper with a separate supplement; for example a magazine or an advertising leaflet. If, in such case, it is desirable to provide some of the newspapers with the supplement while other newspapers are to be distributed without the supplement, the component product feed station which conveys the supplements to the receiving positions may be operated in such a manner that only every second receiving position running past the station is charged with a supplement. In this manner, a product stream results, at the end of the drum system or circulating system, which comprises assembled newspapers with only every second newspaper provided with a supplement. This product stream may then be divided up into a product stream with supplements and a product stream without supplements. The two product streams can then be fed to separate further processing stations, for example to packaging stations. Preferably, however, different products are fed to the same packaging station, in which different products are packaged to form a packaging unit.

The method of the invention may also be used to produce newspapers, periodicals and the like where some are to be provided with a first supplement and some are to be provided with a second supplement which is different from the first supplement. In this case, two component product feed stations charging the receiving positions with supplements are operated in the above described manner, a first station charging every second receiving position with the first supplement and a second station charging a second supplement into or onto those receiving positions which are located, in each case, between two receiving positions charged with the first supplement. The final result, at the outlet of the drum system or circulating system, comprises two product streams, of which one comprises newspapers with the first supplement and the other of which comprises newspapers with the second supplement.

The method of the invention may also be used for simultaneous production of newspapers, periodicals and the like containing three or more different supplements, for example. In such case, the stations supplying the supplements are operated so that only every third or every nth receiving position is charged with the supplements or partsheets supplied from the station.

In addition to the aforedescribed simple examples of the method of the invention, considerably more complex embodiments may also be practiced, embodiments in which a large number of the component product feed stations provided, or even all of the stations, interact only with certain of the receiving positions running past them. As a result, a multiplicity of different types of product can be produced simultaneously.

The types of product produced in the aforedescribed this manner may be completely different from one another. However, it is also possible to produce different types of products wherein each differs from each other only with respect to one specific part and each corresponds with respect to another part. The component product feed stations feeding the corresponding parts are operated, in the last-mentioned case, such that they interact with all the receiving positions running past them.

It should also be noted that identical products may be produced without converting the drum system or circulating system.

BRIEF DESCRIPTION OF THE DRAWINGS

The invention is hereinafter explained by way of example, with reference to the drawings, in which.

DETAILED DESCRIPTION OF THE PRESENTLY PREFERRED EMBODIMENTS

Figure 1:
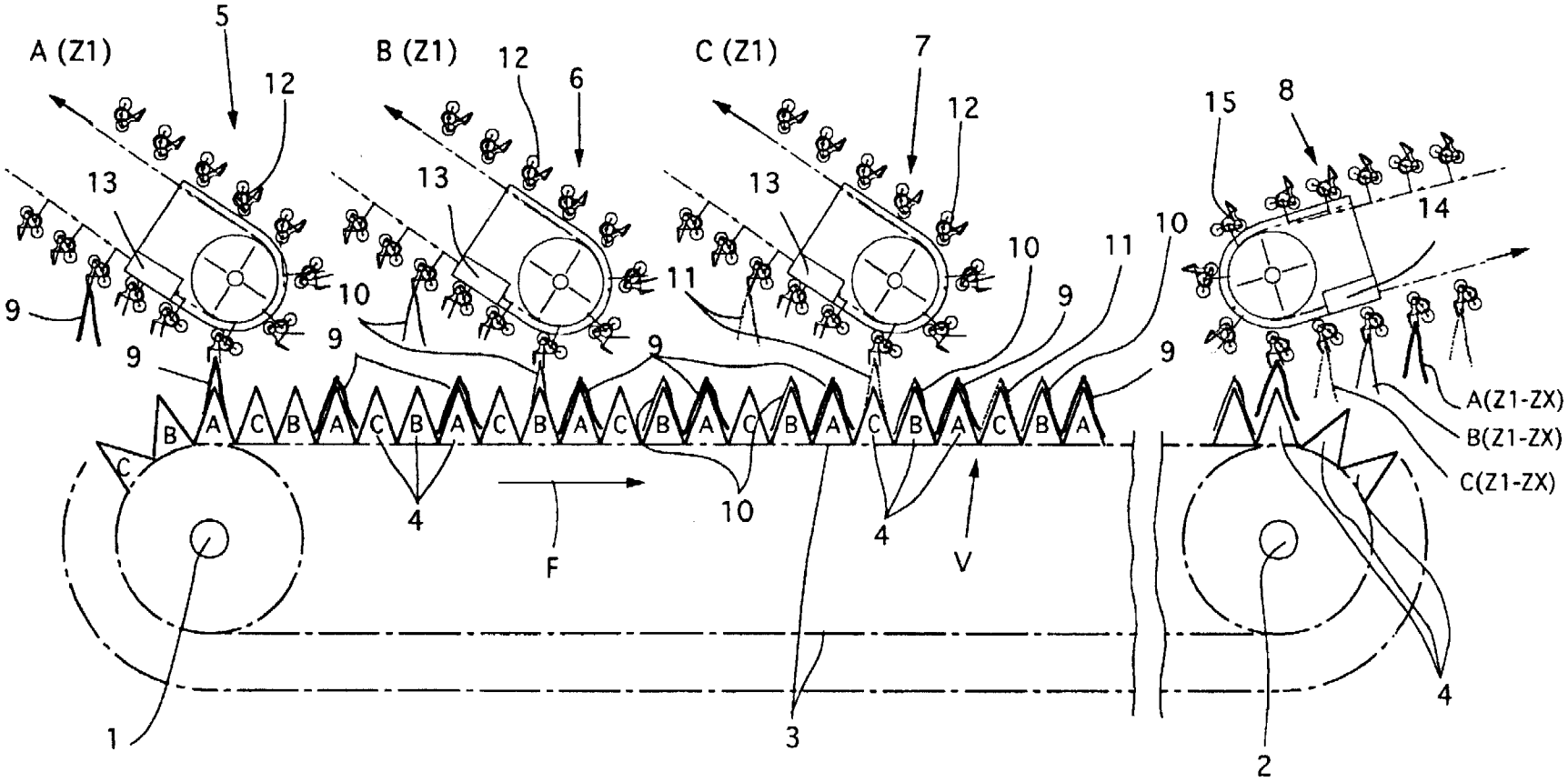
FIG. 1 shows a longitudinal section through a circulating system for carrying out the method according to the invention.

The circulating system which is illustrated in FIG. 1 and is intended for carrying out the method of the invention comprises a conveying device including an endless member 3 which is driven in a circulating path around two, spaced apart, horizontal spindles 1, 2. Saddle-like rests 4 are arranged on the driven member 3 in the manner of ladder rungs. Two, spaced-apart, driven members 3 may also be used.

Driving the endless member 3 in the direction of the arrow (conveying direction F) results in the rests 4 being moved in a horizontal path past component product feed stations 5, 6, 7 which are spaced apart from one another in the conveying direction. These stations 5, 6, 7 are arranged, one behind the other, though a processing section V.

Feed conveyors, each of which is provided with grippers 12 and is of a type of construction which is generally well known, terminate at correspondence processing stations 5, 6 and 7. These feed conveyors feed individual component products 9, 10, 11, each of which may comprise one or more parts, according to the method of the invention. The grippers 12 are each mounted on a conveying element which moves in the direction of the arrow. The conveying direction of the grippers 12 runs, in the transfer region formed between the processing stations 5, 6, 7 and the saddle-like rests 4, in the same direction as, and essentially parallel to, the conveying direction of the moving rests 4.

In this arrangement, the conveying speeds of the grippers 12 and of the rests 4 are coordinated with one another so that successive grippers at each of the processing stations 5, 6 and 7 run past above, and with, successive rests 4. If all the grippers 12 of each the processing stations 5, 6, 7 are provided with component products, all the successive rests 4 will be charged with individual component products by each of the processing stations 5, 6, 7.

However, in the case of operation of the apparatus in FIG. 1, according to the method of the invention, not all the grippers 12 of the processing stations 5, 6, 7 are provided with individual component products. As will be seen, an individual component product 9, 10, 11 is held only in every third gripper 12 of the processing stations 5, 6, 7. As such, with the corresponding synchronization of the conveying speeds of the grippers 12 and of the rests 4, only every third rest 4 is charged by each of the processing stations 5, 6, 7, with the individual component products 9, 10, 11 being supplied by the respective processing station 5, 6, According to the method of the invention illustrated here, a group of rests 4 which is identified by A is assigned to the processing station 5. Another group of rests 4 which is identified by B is assigned to the processing station 6. Yet another group of rests 4 which is identified by C is assigned to the processing station 7. The grippers 12 provided at the processing stations 5, 6, 7 can be actuated automatically by an opening guide 13 in each case, with the result that the individual component products 9, 10, 11 held by the grippers 12 are released above the respective rests 4 in order, and in a straddling manner on the rests 4.

When the rests 4 are charged with individual component products 9, 10, 11 by the processing stations 5, 6, 7 according to the method illustrated in FIG. 1, the processing station 5 charges the group of rests 4 which is identified by A with the first component product of the product A which is to be produced. The processing stations 6, 7, correspondingly, charge those groups of rests 4 which are identified by B and C with respective first individual component products of the products B and C which are to be produced. With this in mind, it will be noted that the processing stations 5, 6, 7 are identified by the symbols A (Z1), B (Z1) and C (Z1).

The processing stations 5, 6, 7 which have been described are, according to the invention, joined by further processing stations downstream of these stations (and not shown in FIG. 1) from which the rests 4 are charged with further individual sub-products. For the case where the product A comprises, for example, X different individual sub-products, the processing stations represented in FIG. 1 are joined by further processing stations A (Z2), A (Z3), . . . A (ZX). Correspondingly, in order to produce the products B and C, further processing stations B (Z2), B (Z3), . . . B (ZX) and C (Z2), C (Z3), . . . C (ZX) are provided. In this arrangement, however, it is not essential for the products A, B and C to comprise the same number of individual component products, since a correspondingly different number of processing stations may be provided for the individual groups of rests 4 in each case.

Likewise, the method of the invention illustrated in FIG. 1 is not restricted to the production of three different types of products. Only two, or more than three, different types of product may be produced. The maximum number of different types of product is theoretically restricted only by the total number of rests 4 present.

If desired, the method of the invention may also be used to produce products of the same type. No conversion work on the circulating system is necessary for this purpose.

According to the method of the invention illustrated in FIG. 1, the processing stations for producing different types of product are arranged in such a manner that they can be arranged adjacent to each other in groups. Specifically, it will be seen that all those processing stations, by means of which the first individual component product of each different type of product A, B, C is fed to the rests 4, are arranged such that they are immediately adjacent one another. Thereafter, they are followed by additional processing stations (not shown in FIG. 1) from which the rests 4, that received components 9, 10 and 11 for products A, B and C respectfully, are charged with the second individual component products of the products A, B and C which are to be produced. This results in successive processing stations charging different rests in each case.

Within the context of the invention, however, it is, also possible to arrange the processing stations for producing different types of products so that those stations which cooperate to produce a single type of product are arranged together, one directly behind the other. In this case, the processing stations arranged one behind the other charge the same rests with individual component products in each case. For example, the processing stations 5, 6 and 7, of FIG. 1, could each charge a component of a product to the same rest 4. Such a method is further described below with reference to a method of the invention illustrated in FIG. 2.

In the method illustrated in FIG. 1, the individual subproducts 9, 10, 11 are collected on the rests 4, i.e., placed one over the other. However, it is also possible to collate and/or insert the individual component products 9, 10, 11 (in a manner known, per se) between the correspondingly designed elements which delimit compartments, i.e., the rests 4, in this case. The three ways of bringing together individual component products: "collecting", "collating" and "inserting" can be combined in any manner during the production of a product.

Downstream of the processing stations 5, 6 and 7, which serve to feed individual component products 9, 10 and 11, is a processing station 8 for removing and conveying away the assembled products. This processing station 8 is the starting point for a removal conveyor which is of a known construction and contains grippers 15 which are arranged at regular intervals on an endless conveyor element.

In the embodiment shown in FIG. 1, only a single removal station 8 is provided, at which all the assembled products are removed from the rests 4. The assembled products removed and conveyed away from the overall apparatus are the products of the aforementioned type A, B and C, each of which comprises X individual component products and each of which is identified in FIG. 1 by A (Z1–ZX), B (Z1–ZX) and C (Z1–ZX).

The removal station 8 is provided with a closing guide 14 which, in a precise manner, closes the grippers 15 moving in the direction of the arrow whenever the corresponding gripper is located above a rest 4 with an assembled product. In this manner, the assembled products are seized and conveyed away from the apparatus.

The conveying speeds of the rests 4 and of the grippers 15 are synchronized. Accordingly, the grippers 15, which follow directly one after the other, can readily grip and raise up assembled products from the rests 4 which follow directly one after the other.

In an alternative to the assembled product removal station 8 arrangement shown in FIG. 1, it is also contemplated that a separate removal station for each type of assembled product produced may be provided. In such case, each removal station would only convey away assembled products of a specific type.

Figure 2:
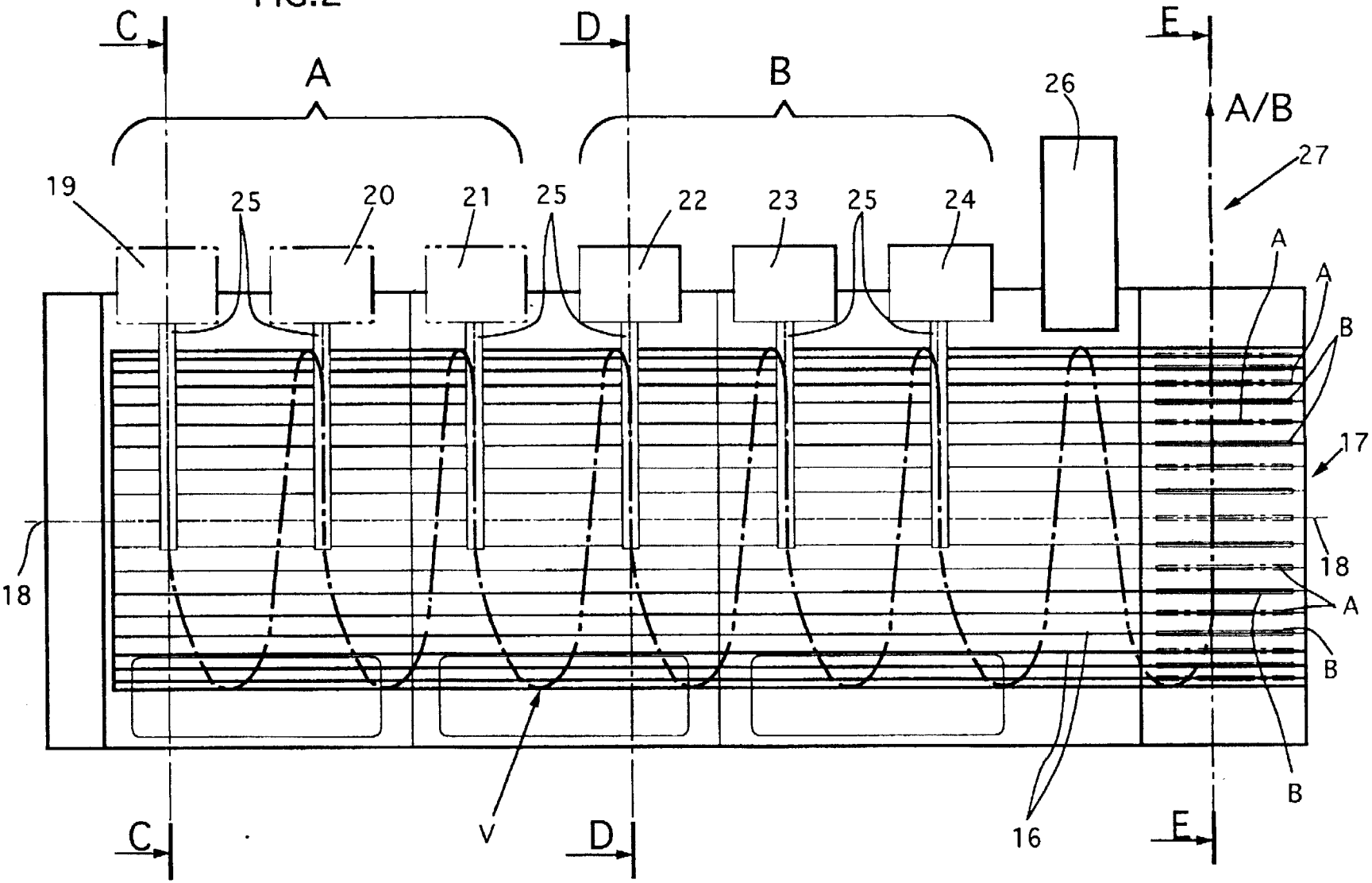
FIG. 2 shows an elevation of a drum system for carrying out the method according to the invention.

Referring now to FIG. 2, another type of system for practicing the method of the invention is illustrated. FIG. 2 shows a drum system which is utilized in carrying out the method of the invention.

In the apparatus shown in FIG. 2, the saddle-like rests 16 are fitted not, as in the case of FIG. 1, on a circulating drawing member, but on a rigid cylindrical drum 17 which is driven in rotation. The saddle-like rests 16, which run in the direction of the axis of rotation (longitudinal axis) 18 of the drum 17, extend radially outwardly from that axis of rotation.

Provided along the drum 17, parallel to its axis, are processing stations 19–24. The stations 19–24 are for charging the rests 16 of the drum 17 with individual component products (not shown in FIG. 2). In this arrangement, charging takes place (analogously to FIG. 1) in a known manner by conveying elements 25 which are provided with grippers and extend away from the drum 17 above the axis of rotation 18 thereof. In this arrangement in FIG. 2, the conveying elements 25 are represented only schematically, without grippers and without the individual component products being transported.

The processing stations 19–24, which are feed stations, are adjoined by a further processing station 26 in the form of a stapling or adhesive-bonding station, for example. Adjoining the further processing station 26 is a product-removal station 27 (not shown in detail in FIG. 2). There, by means of a removal conveyor which carries grippers, the assembled products are removed from the rests 16 and transported away in the direction of the arrow.

In operation of the apparatus represented in FIG. 2, the drum 17 is made to rotate. From the processing station 19, the rests 16 are then charged with first individual component products of a product A which is to be produced. The individual component products may be part-products or part-sheets. Every second rest of the rests 16, which follow one after the other in the circumferential direction of the drum 17, is excluded from the charging by the processing station 19.

The individual component products deposited on the rests 16 in this manner then travel through a first portion of an approximately helical path in the processing section V, until they reach the conveying means 25 of the next processing station 20. There, in each case, a second individual component product required for the production of the product A is deposited on the individual component product supplied by the previous processing station 19. The processing station 20 also charges only every second rest 16. Again, it is precisely those rests which were excluded from the charging operation by the processing station 19 which are excluded from the charging here.

In order to cause the individual component products deposited on the rests 16 to be moved along the aforementioned helical path 27, provision is made on the drum 17, in a known manner, for axial transporting means. These axial transporting means, associated with each of the rests 16, move the component products in the axial direction and, for reasons of clarity, are not represented in FIG. 2.

The partially assembled product, at this time comprising two individual component products, is then transported further along the processing section V in the direction of the processing station 21. There, a third individual component product is deposited on the two previously deposited individual component products.

After the third individual component product has been deposited on the rests 16 by the processing station 21, the assembled product A comprising three individual component products is complete. At this point an assembled product A is located on every second rest 16, immediately after the processing station 21 in the conveying direction. The rests 16 located between them are still empty.

The empty rests 16 are charged, beginning at the processing station 22, with a first individual component product required for the production of a product B. The processing stations 23 and 24 following the processing station 22 charge the same rests 16 charged by the processing station 22 with the second and third individual component products required for assembling the product B.

Thus, those rests 16 which, when between the processing stations 21 and 22 are still empty, are charged by the processing stations 22, 23 and 24 with the individual component products which are required for producing the product B. As a result, an assembled product A or B is seated on each rest 16 immediately after the processing station 24, the products A and B alternating in the circumferential direction on the drum 17.

After leaving the processing station 24, the assembled products A, B reach the processing station 26. The station 26 is designed, for example, as a stapling or adhesive-binding station by means of which the individual component products of the products A, B are stapled or glued together. The processing station 26 is operated, unlike the processing stations 19–24, so that all the rests 16 of the drum 17, which follow one after the other in the circumferential direction, are processed one after the other.

After leaving the processing station 26, the assembled products A, B reach the product-removal station 27. There they are conveyed away from the drum 17 in the direction of the arrow. Due to the alternating arrangement of the products A, B on the rests 16 of the drum 17, the products A, B are conveyed away alternately from the apparatus.

Figure 3:
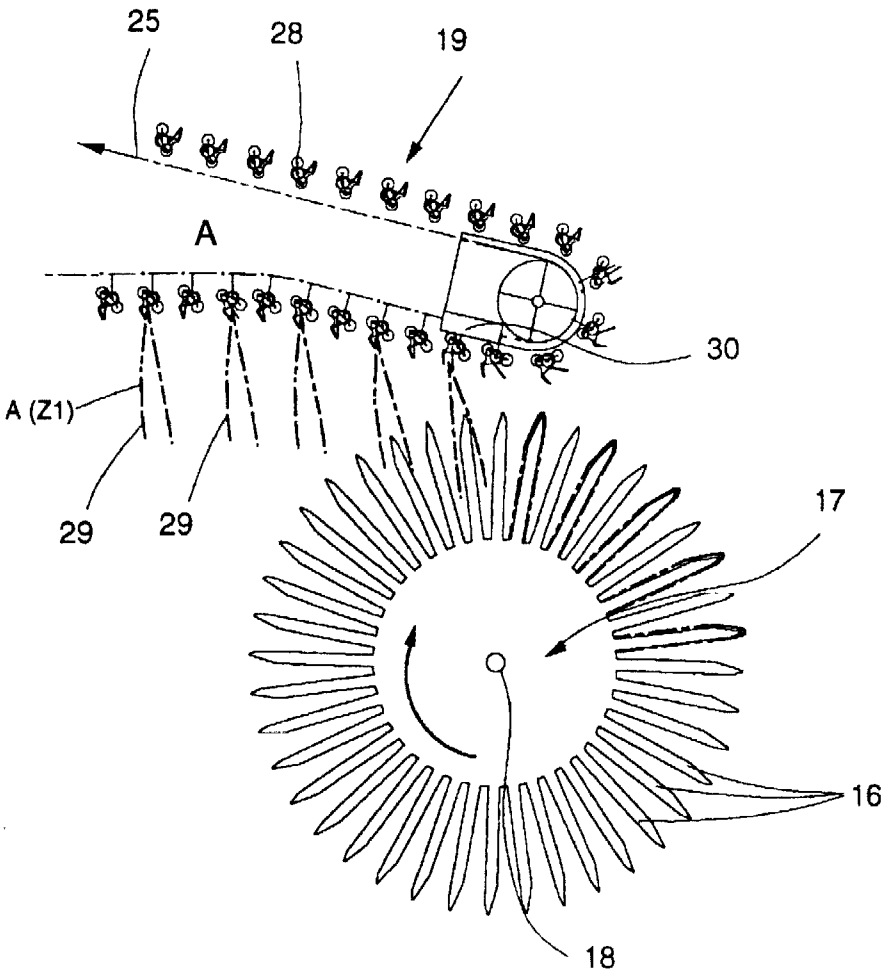
FIG. 3 shows a section along section line C—C of FIG. 2, in collecting operation.

Referring now to FIG. 3, the processing station 19 seen in FIG. 2, at which a feed conveyor provided with grippers 28 which move in the direction of the arrow terminates, is illustrated. Every second gripper 28 carries the first individual component product 29 required for producing the product A. Shown beneath the processing station 19 is the drum 17, rotating about its axis of rotation 18, with the saddle-like rests 16 extending radially from it. By synchronizing the speed of rotation of the drum 17 and the conveying speed of the grippers 28, as well as the activation of the opening guide 30 of the processing station 19, every second rest 16 of the drum 17 is charged with an individual component product 29.

Figure 4:
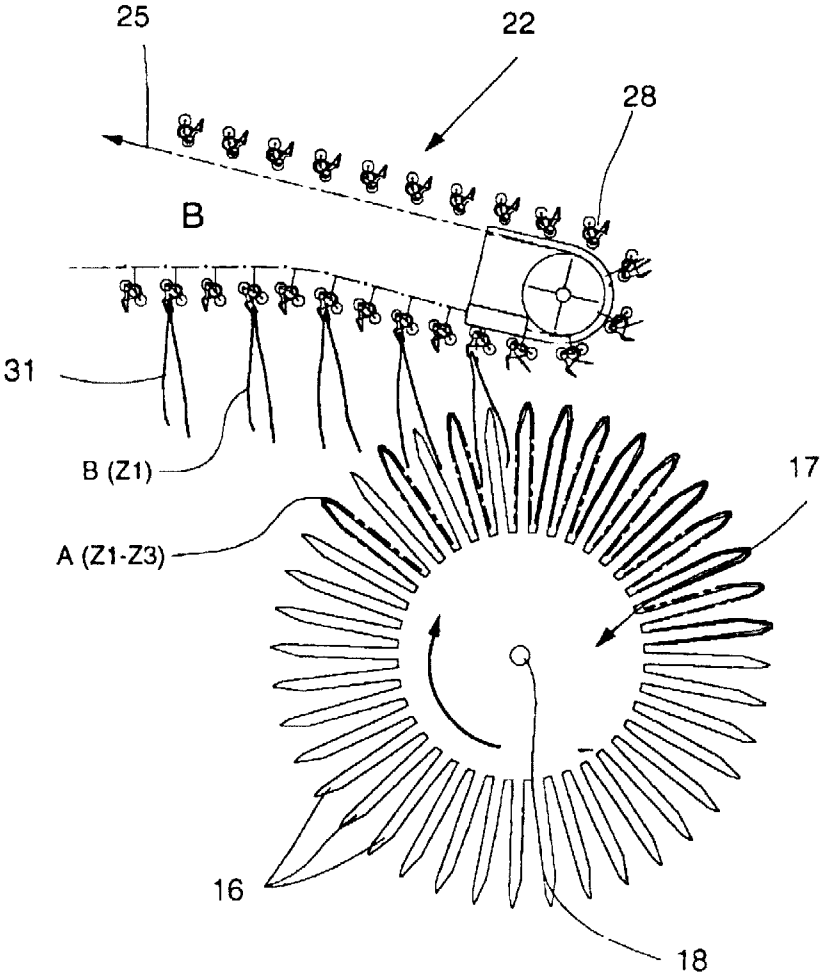
FIG. 4 shows a Section along section line D—D of FIG. 2, in collecting operation.

Referring now to FIG. 4, the construction and mode of operation of the processing station 22 shown in FIG. 2 is illustrated. The station 22 corresponds to the processing station 19 described with reference to FIG. 3.

At the processing station 22, all the individual component products A (Z1), A (Z2) and A (Z3) which are required for producing the assembled product A are already in place, one on top of the other, on the rests 16 of the drum 17. However, only every second rest of the rests 16 following one after the other in the circumferential direction of the drum 17 has been charged with individual component products of the product A. The rests arranged between the rests 16 which have already been charged, are empty. At the processing station 22, these empty rests are charged for the first time with the individual component products 31 or B (Z1) which are required for producing the product B.

Figures 5, 6, 7:
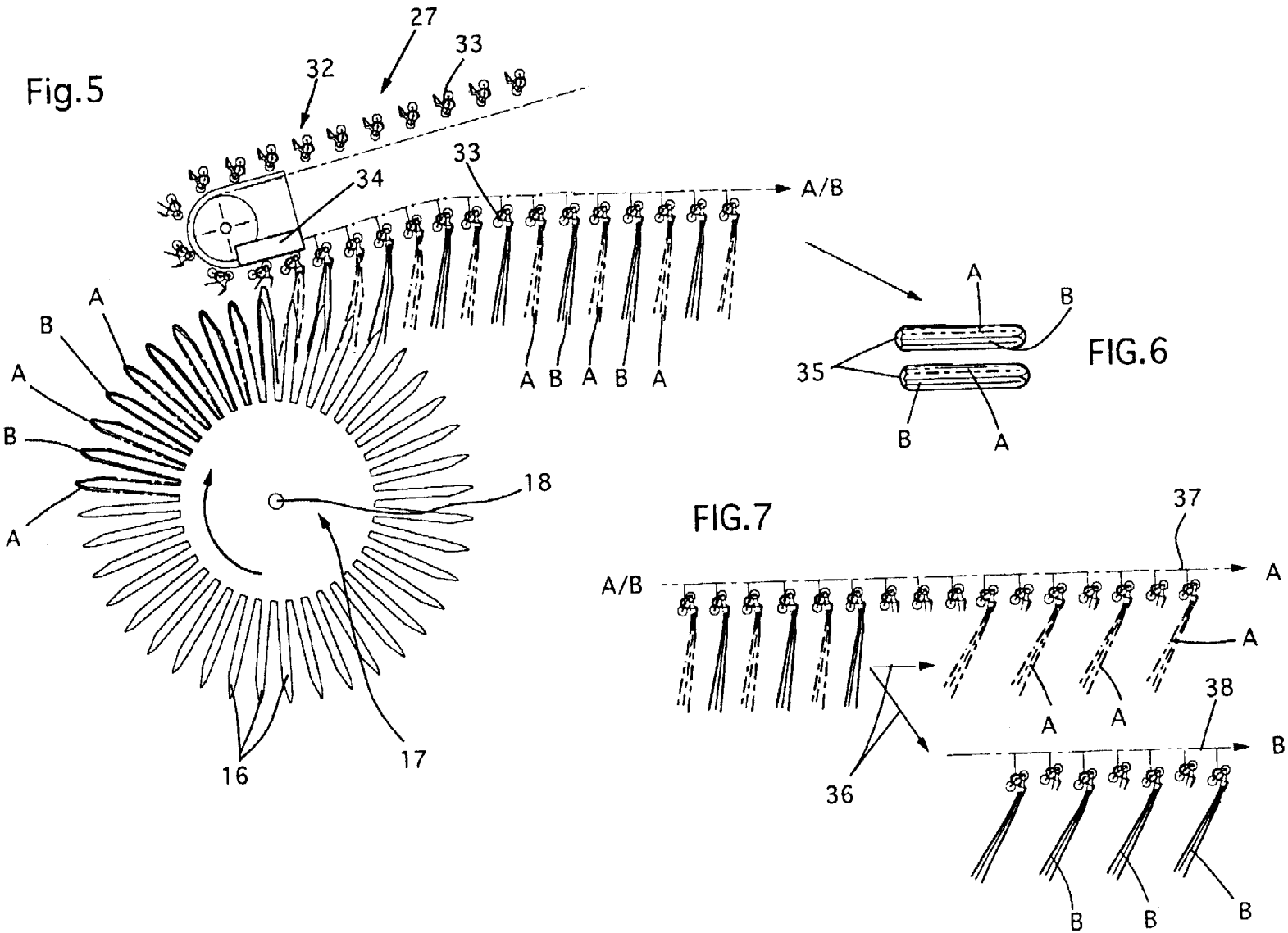
FIG. 5 shows a section along section line E—E of FIG. 2.
FIG. 6 shows products which have been produced and packaged by a method according to the invention.
FIG. 7 shows an apparatus for taking away products which have been produced according to the method of the invention.

Referring now to FIG. 5, a section along section line E—E of FIG. 2 showing the removal station 27 is illustrated. The removal station 27 includes a removal conveyor with grippers 33 which move in the direction of the arrow and are closed by a closing guide 34 arranged above the drum 17.

On the rests 16 of the drum 17, at this point, the assembled and stapled or glued products A and B are located in an alternating sequence with respect to the direction of rotation of the drum 17. By closing the grippers 33 with the closing guide 34, the finished products A, B are there seized and raised up from the rests 16 and conveyed away from the removal station 27 in the direction of the arrow. In the case of this conveying operation, the products A, B follow, one after the other, in alternating sequence.

The products A, B conveyed away in this manner are preferably further processed by being packaged together, as seen in FIG. 6. In this arrangement, according to the example shown in FIG. 6, two products A, B which follow one after the other are provided with a common wrapping 35.

If more than two different types of products are produced by means of a method embodying the invention, correspondingly more products may also be packaged together. This is made possible in a simple manner; in particular, if the removal conveyor conveys away the different types of product directly, one after the other, from the assembly apparatus.

In addition to the common further processing of products following directly one after the other, as seen in FIG. 6, it is, as seen in FIG. 7, also possible to divide up the product stream by means of a diverter illustrated by arrows 36 in FIG. 7, where it diverts the assembled products into two separate product streams 37, 38. The product stream 37 exclusively comprises products A and the product stream 38 exclusively comprises products B. In this manner, the different types of products can be separately delivered for separate further processing.

Figure 9:
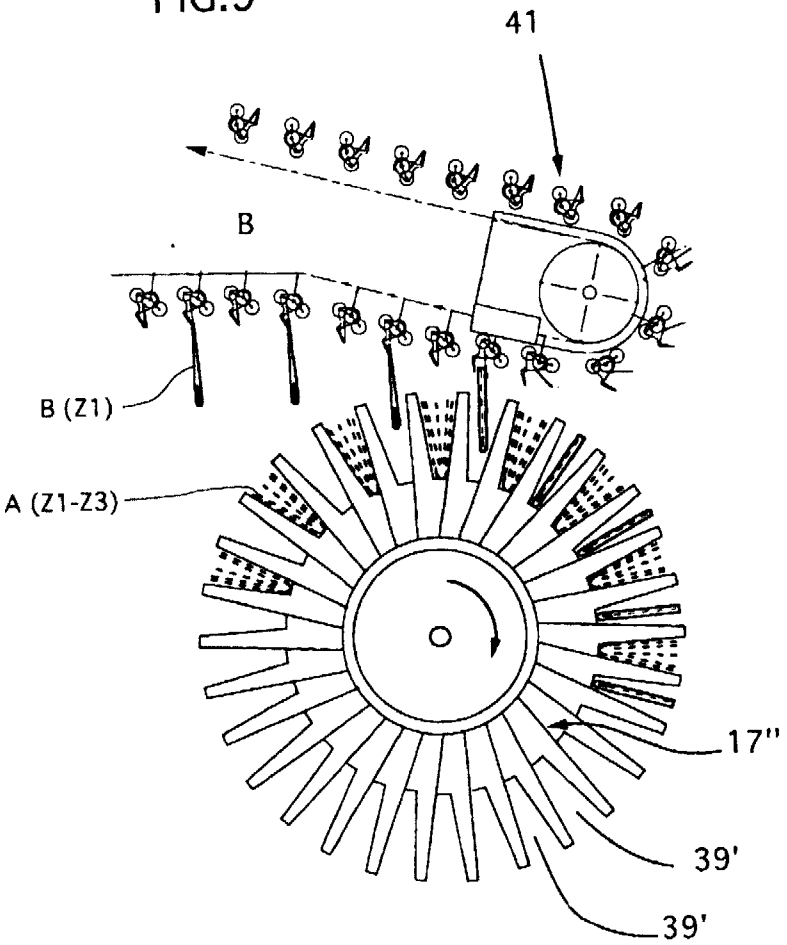
FIG. 9 shows a drum system for carrying out the method according to the invention by means of which individual component products are inserted.
Figure 8:
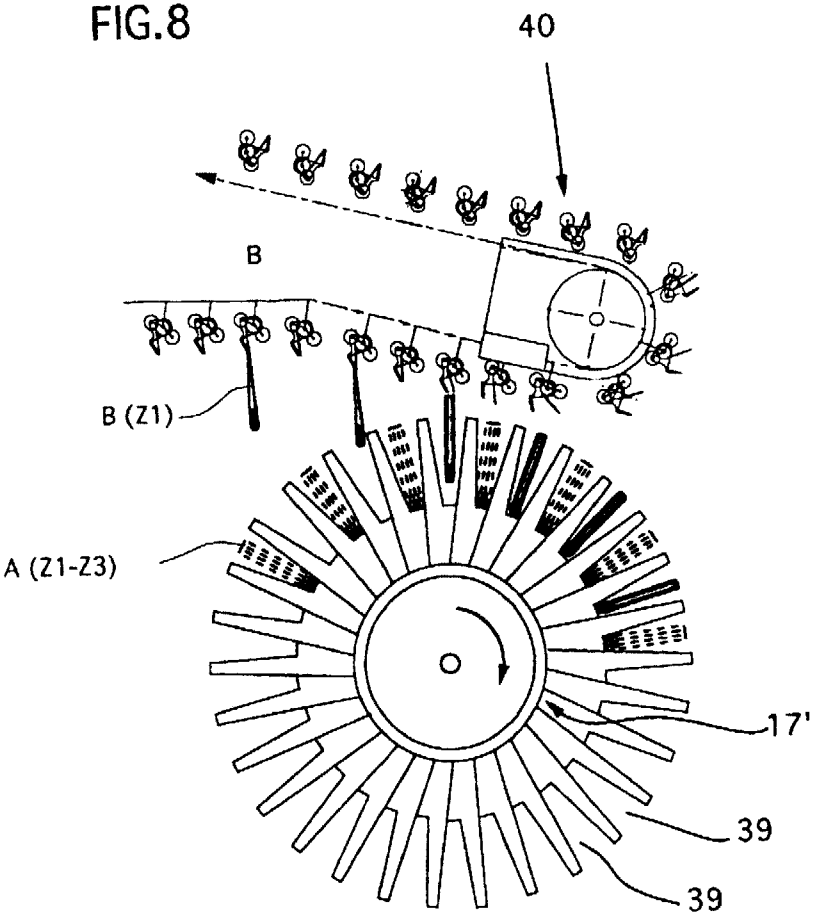
FIG. 8 shows a drum system for carrying out the method according to the invention by means of which individual component products are collated.

FIGS. 8 and 9 are substantially similar to FIG. 4. The difference is that the drum 17' shown in FIG. 8 comprises pockets 39 in which the individual component products are collated, in a known manner, instead of saddle-like rests on which they are collected. In this arrangement, FIG. 8 shows products A (Z1–Z3) which are already collated, comprising in each case, three individual component products located one beside the other. These component products are deposited only in every second pocket 39 of the drum 17'. The processing station 40, in turn, deposits first individual component products B (Z1), which are required for producing the product B, into the still empty pockets 39.

FIG. 9 is similar to FIG. 8, but shows a drum 17" in which the products A, B are brought together by insertion. In the case of the apparatus shown in FIG. 9, the pockets 39' of the drum 17" are provided, in a known manner, with conventional mechanisms for opening and holding open the individual component products already located in the pockets. This permits insertion of further individual component products.

Drum systems which are suitable for practicing the method of the invention and are intended for collecting, inserting and/or collating are described, for example, in U.S. Pat. Nos. 3,951,399, 4,058,202, 5,052,667, 5,324,014, 5,052,666, and 5,094,438. Circulating systems which are suitable for practicing the method of the invention and are intended for collecting, inserting and/or collating are described, for example, in U.S. Pat. Nos. 4,489,930 and 5,104,108.

I claim:

1. A method of simultaneously producing different types of assembled printed products each consisting of a plurality of components, comprising the steps of providing a plurality of stationarily arranged processing stations; providing a plurality of receiving members; moving said plurality of receiving members, one behind the other, along a path past said processing stations; feeding components of products to receiving members, from processing stations such that the components of a particular type of products are fed to selected receiving members from one or more processing stations to insure that each receiving member is provided with only components that belong to products of the same type; and then conveying away the assembled product from the receiving members; and further characterized in that products of different types are removed from different removal stations.

2. The method of claim 1 further characterized in that, in order to produce a first type of product, a first group of receiving positions is assigned to a first group of processing stations and, in order to produce a second type of product, another group of receiving members is assigned to another group of processing stations.

3. The method of claim 2 further characterized in that, for each type of product being produced, a separate group of receiving members and a separate group of processing stations are provided.

4. The method of claim 1 further characterized in that, in order to produce one type of product, specific processing stations charge only every nth receiving member with individual products where n>1.

5. The method of claim 2 further characterized in that the processing stations of one group are arranged directly one behind the other.

6. The method of claim 2 further characterized in that the processing stations of different groups are arranged adjacent to each other in a group.

7. The method of claim 1 further characterized in that specific processing stations in the form of stapling or adhesive-bonding stations are assigned to a plurality of, or all of, the groups of receiving members.

8. The method of claim 1 further characterized in that all the products are removed from a single removal station.

9. A method of simultaneously producing different types of assembled printed products each consisting of a plurality of components, comprising the steps of providing a plurality of stationarily arranged processing stations; providing a plurality of receiving members; moving said plurality of receiving members, one behind the other, along a path past said processing stations; feeding components of products to receiving members, from processing stations such that the components of a particular type of products are fed to selected receiving members from one or more processing stations to insure that each receiving member is provided with only components that belong to products of the same type; and then conveying away the assembled product from the receiving members; and further characterized in that the removed products are divided up into different product streams for further processing.

10. A method of simultaneously producing different types of assembled printed products each consisting of a plurality of components, comprising the steps of providing a plurality of stationarily arranged processing stations; providing a plurality of receiving members; moving said plurality of receiving members, one behind the other, along a path past said processing stations; feeding components of products to receiving members, from processing stations such that the components of a particular type of products are fed to selected receiving members from one or more processing stations to insure that each receiving member is provided with only components that belong to products of the same type; and then conveying away the assembled product from the receiving members; and further characterized in that, in each case, a specific number of different products following directly one after the other are processed further together and then packaged together.

11. The method of claim 1 further characterized in that the component products are collected on the receiving members.

12. The method of claim 1 further characterized in that the component products are collated in the receiving members.

13. The method of claim 1 further characterized in that the component products are inserted in the receiving members.

14. A method of simultaneously producing different types of assembled printed products each consisting of a plurality of components, comprising the steps of providing a plurality of stationarily arranged processing stations; providing a plurality of receiving members; moving said plurality of receiving members, one behind the other, along a path past said processing stations; feeding components of products to receiving members, from processing rotations such that the components of a particular type of products are fed to selected receiving members from one or more processing stations to insure that each receiving member is provided with only components that belong to products of the same type; and then conveying away the assembled product from the receiving members; and further characterized in that, during the conveying operation, at least one of the component products fed to a receiving member and the products guided away from said receiving member are held by automatically actuable grippers.

15. The method of claim 8 further characterized in that the removed products are divided up into different product streams for further processing.

16. The method of claim 1 further characterized in that, in each case, a specific number of different products following directly one after the other are processed further together and then packaged together.

17. The method of claim 1 further characterized in that, during the conveying operation, at least one of the component products fed to a receiving member and the products guided away from said receiving member are held by automatically actuable grippers.

18. The method of claim 9 further characterized in that, in order to produce a first type of product, a first group of receiving positions is assigned to a first group of processing stations and, in order to produce a second type of product, another group of receiving members is assigned to another group of processing stations.

19. The method of claim 18 further characterized in that, for each type of product being produced, a separate group of receiving members and a separate group of processing stations are provided.

20. The method of claim 9 further characterized in that, in order to produce one type of product, specific processing stations charge only every nth receiving member with individual products where n>1.

21. The method of claim 18 further characterized in that the processing stations of one group are arranged directly one behind the other.

22. The method of claim 18 further characterized in that the processing stations of different groups are arranged adjacent to each other in a group.

23. The method of claim 9 further characterized in that specific processing stations in the form of stapling or adhesive-bonding stations are assigned to a plurality of, or all of, the groups of receiving members.

24. The method of claim 9 further characterized in that all the products are removed from a single removal station.

25. The method of claim 9 further characterized in that, in each case, a specific number of different products following directly one after the other are processed further together and then packaged together.

26. The method of claim 9 further characterized in that the component products are collected on the receiving members.

27. The method of claim 9 further characterized in that the component products are collated in the receiving members.

28. The method of claim 9 further characterized in that the component products are inserted in the receiving members.

29. The method of claim 9 further characterized in that, during the conveying operation, at least one of the component products fed to a receiving member and the products guided away from said receiving member are held by automatically actuable grippers.

30. The method of claim 10 further characterized in that, in order to produce a first type of product, a first group of receiving positions is assigned to a first group of processing stations and, in order to produce a second type of product, another group of receiving members is assigned to another group of processing stations.

31. The method of claim 30 further characterized in that, for each type of product being produced, a separate group of receiving members and a separate group of processing stations are provided.

32. The method of claim 10 further characterized in that, in order to produce one type of product, specific processing stations charge only every nth receiving member with individual products where n>1.

33. The method of claim 30 further characterized in that the processing stations of one group are arranged directly one behind the other.

34. The method of claim 30 further characterized in that the processing stations of different groups are arranged adjacent to each other in a group.

35. The method of claim 10 further characterized in that specific processing stations in the form of stapling or adhesive-bonding stations are assigned to a plurality of, or all of, the groups of receiving members.

36. The method of claim 10 further characterized in that all the products are removed from a single removal station.

37. The method of claim 10 further characterized in that the component products are collected on the receiving members.

38. The method of claim 10 further characterized in that the component products are collated in the receiving members.

39. The method of claim 10 further characterized in that the component products are inserted in the receiving members.

40. The method of claim 10 further characterized in that, during the conveying operation, at least one of the component products fed to a receiving member and the products guided away from said receiving member are held by automatically actuable grippers.

41. The method of claim 14 further characterized in that, in order to produce a first type of product, a first group of receiving positions is assigned to a first group of processing stations and, in order to produce a second type of product, another group of receiving members is assigned to another group of processing stations.

42. The method of claim 41 further characterized in that, for each type of product being produced, a separate group of receiving members and a separate group of processing stations are provided.

43. The method of claim 14 further characterized in that, in order to produce one type of product, specific processing stations charge only every nth receiving member with individual products where n>1.

44. The method of claim 41 further characterized in that the processing stations of one group are arranged directly one behind the other.

45. The method of claim 41 further characterized in that the processing stations of different groups are arranged adjacent to each other in a group.

46. The method of claim 14 further characterized in that specific processing stations in the form of stapling or adhesive-bonding stations are assigned to a plurality of, or all of, the groups of receiving members.

47. The method of claim 14 further characterized in that all the products are removed from a single removal station.

48. The method of claim 10 further characterized in that the component products are collected on the receiving members.

49. The method of claim 14 further characterized in that the component products are collated in the receiving members.

50. The method of claim 14 further characterized in that the component products are inserted in the receiving members.

* * * * *